US009182700B2

(12) United States Patent
Kano et al.

(10) Patent No.: US 9,182,700 B2
(45) **Date of Patent: *Nov. 10, 2015**

(54) CLEANING MEMBER FOR IMAGE FORMING APPARATUS, CHARGING DEVICE, UNIT FOR IMAGE FORMING APPARATUS, PROCESS CARTRIDGE, IMAGE FORMING APPARATUS

(75) Inventors: Fuyuki Kano, Kanagawa (JP); Takeshi Kawai, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 171 days.

This patent is subject to a terminal disclaimer.

(21) Appl. No.: 13/439,513

(22) Filed: Apr. 4, 2012

(65) Prior Publication Data

US 2013/0089354 A1 Apr. 11, 2013

(30) Foreign Application Priority Data

Oct. 7, 2011 (JP) ..... 2011-222954

(51) Int. Cl.
*G03G 15/02* (2006.01)

(52) U.S. Cl.
CPC ..... *G03G 15/0225* (2013.01)

(58) Field of Classification Search
CPC ..... G03G 15/0225; G03G 21/18
USPC ..... 399/100, 357
See application file for complete search history.

(56) References Cited

U.S. PATENT DOCUMENTS

| | | | | |
|---|---|---|---|---|
| 7,844,195 | B2 * | 11/2010 | Sasagawa | 399/100 |
| 2003/0147676 | A1 * | 8/2003 | Sakata et al. | 399/286 |
| 2008/0253817 | A1 | 10/2008 | Sasagawa | |
| 2009/0297230 | A1 * | 12/2009 | Koyanagi et al. | 399/281 |
| 2010/0104316 | A1 * | 4/2010 | Hoshio et al. | 399/100 |
| 2011/0170900 | A1 | 7/2011 | Suto | |
| 2011/0236052 | A1 * | 9/2011 | Takagi et al. | 399/100 |
| 2013/0108311 | A1 * | 5/2013 | Kawai et al. | 399/100 |

FOREIGN PATENT DOCUMENTS

| | | |
|---|---|---|
| CN | 101334623 A | 12/2008 |
| CN | 101727045 A | 6/2010 |
| JP | A-2-272594 | 11/1990 |
| JP | A-7-129055 | 5/1995 |

(Continued)

OTHER PUBLICATIONS

Mar. 12, 2013 Office Action issued in Japanese Patent Application No. 2011-222954 (with translation).

(Continued)

*Primary Examiner* — Ryan Walsh
*Assistant Examiner* — Philip Marcus T Fadul
(74) *Attorney, Agent, or Firm* — Oliff PLC

(57) ABSTRACT

A cleaning member for an image forming apparatus, includes a core, a foamed elastic layer disposed by winding a strip-shaped foamed elastic member on an outer peripheral surface of the core in a helical form so as to extend from one end of the core to the other end, and a bonding layer for bonding the core and the foamed elastic layer together, wherein the area of a region within a surface at one or both ends at least in a longitudinal direction of the foamed elastic layer on a side facing the outer peripheral surface of the core, contacting the outer peripheral surface of the core via the bonding layer is substantially 35% or more by area ratio per unit area.

14 Claims, 8 Drawing Sheets

(56) References Cited

FOREIGN PATENT DOCUMENTS

| | | |
|---|---|---|
| JP | A-7-219313 | 8/1995 |
| JP | A-2000-310924 | 11/2000 |
| JP | A-2001-209238 | 8/2001 |
| JP | A 2009-184833 | 8/2009 |
| JP | A-2010-231165 | 10/2010 |
| JP | A-2010-286713 | 12/2010 |
| JP | A-2011-145409 | 7/2011 |
| JP | A-2011-145412 | 7/2011 |

OTHER PUBLICATIONS

Translation of Office Action issued Jul. 15, 2014 in Japanese Patent Application No. 2013-214839.

Jun. 17, 2015 Office Action issued in Chinese Application No. 201210140236.6.

* cited by examiner

CLEANING MEMBER FOR IMAGE FORMING APPARATUS, CHARGING DEVICE, UNIT FOR IMAGE FORMING APPARATUS, PROCESS CARTRIDGE, IMAGE FORMING APPARATUS

CROSS-REFERENCE TO RELATED APPLICATIONS

This application is based on and claims priority under 35 USC 119 from Japanese Patent Application No. 2011-222954 filed Oct. 7, 2011.

BACKGROUND (i) Technical Field

The present invention relates to a cleaning member for an image forming apparatus, a charging device, a unit for an image forming apparatus, a process cartridge, and an image forming apparatus.

(ii) Related Art

According to an electrophotographic image forming apparatus, a surface of an image carrying member formed of a photoconductor or the like is charged by a charging device to form charges, and an electrostatic latent image is formed by, for example, a laser beam obtained by modulating an image signal. After that, the electrostatic latent image is developed with charged toner to form a visible toner image. The toner image is electrostatically transferred onto a member to be transferred such as a recording sheet either directly or via an intermediate transfer member and fixed onto the member to be transferred to obtain an image.

SUMMARY

According to an aspect of the present invention, there is provided a cleaning member for an image forming apparatus, including: a core; a foamed elastic layer disposed by winding a strip-shaped foamed elastic member on an outer peripheral surface of the core in a helical form so as to extend from one end of the core to the other end; and a bonding layer for bonding the core and the foamed elastic layer together, wherein the area of a region within a surface at one or both ends at least in a longitudinal direction of the foamed elastic layer on a side facing the outer peripheral surface of the core, contacting the outer peripheral surface of the core via the bonding layer is substantially 35% or more by area ratio per unit area.

BRIEF DESCRIPTION OF THE DRAWINGS

Exemplary embodiments of the present invention will be described in detail based on the following figures, wherein.

DETAILED DESCRIPTION

Figure 1:
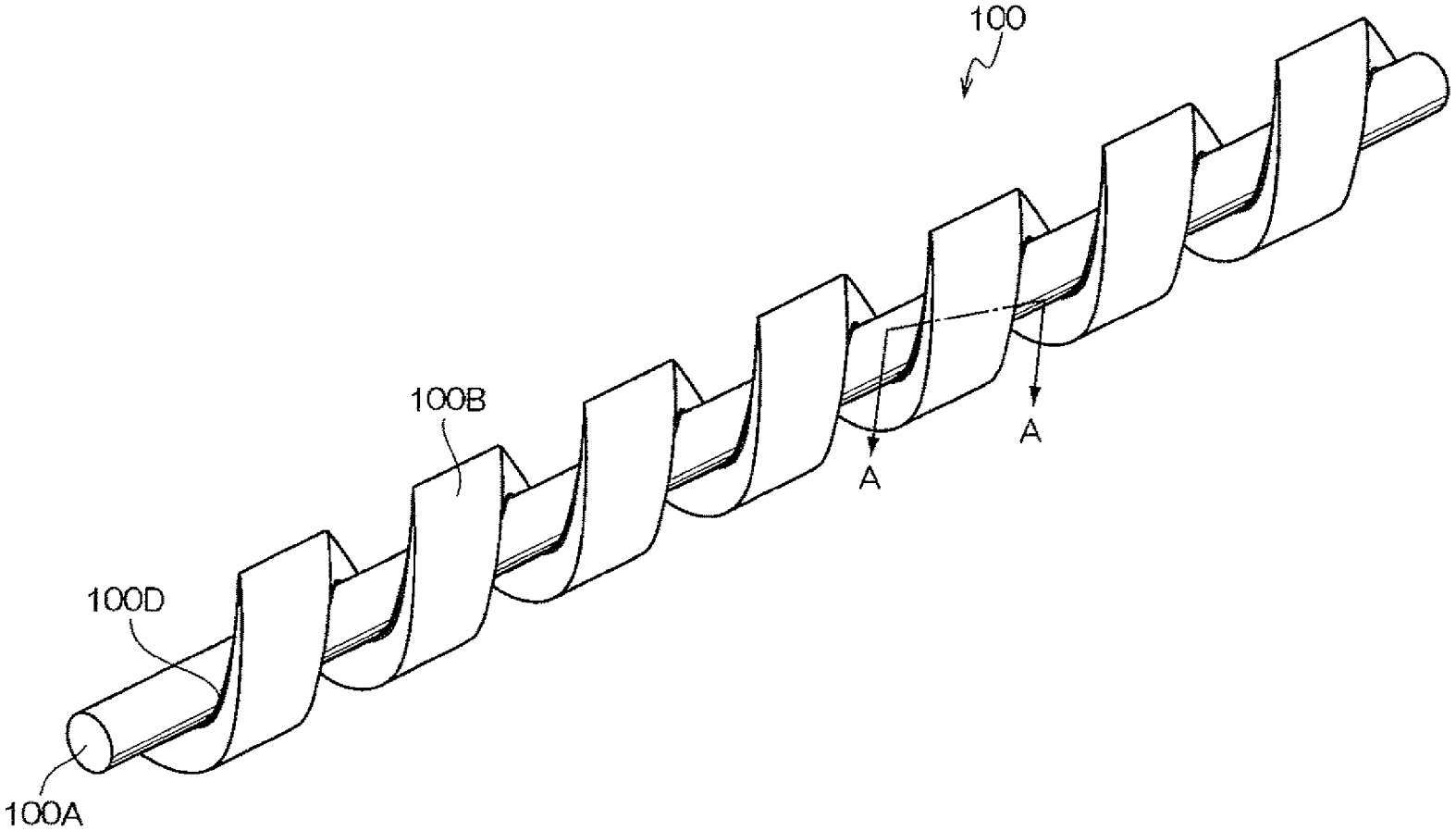
FIG. 1 is a schematic perspective view showing a cleaning member for an image forming apparatus according to an exemplary embodiment of the present invention.

Hereinafter, an exemplary embodiment which is an example of the present invention will be described. In the following description, members having substantially the same functions and effects will be denoted by the same reference numerals throughout all drawings, and redundant description is omitted appropriately.

(Cleaning Member)

Figure 2:
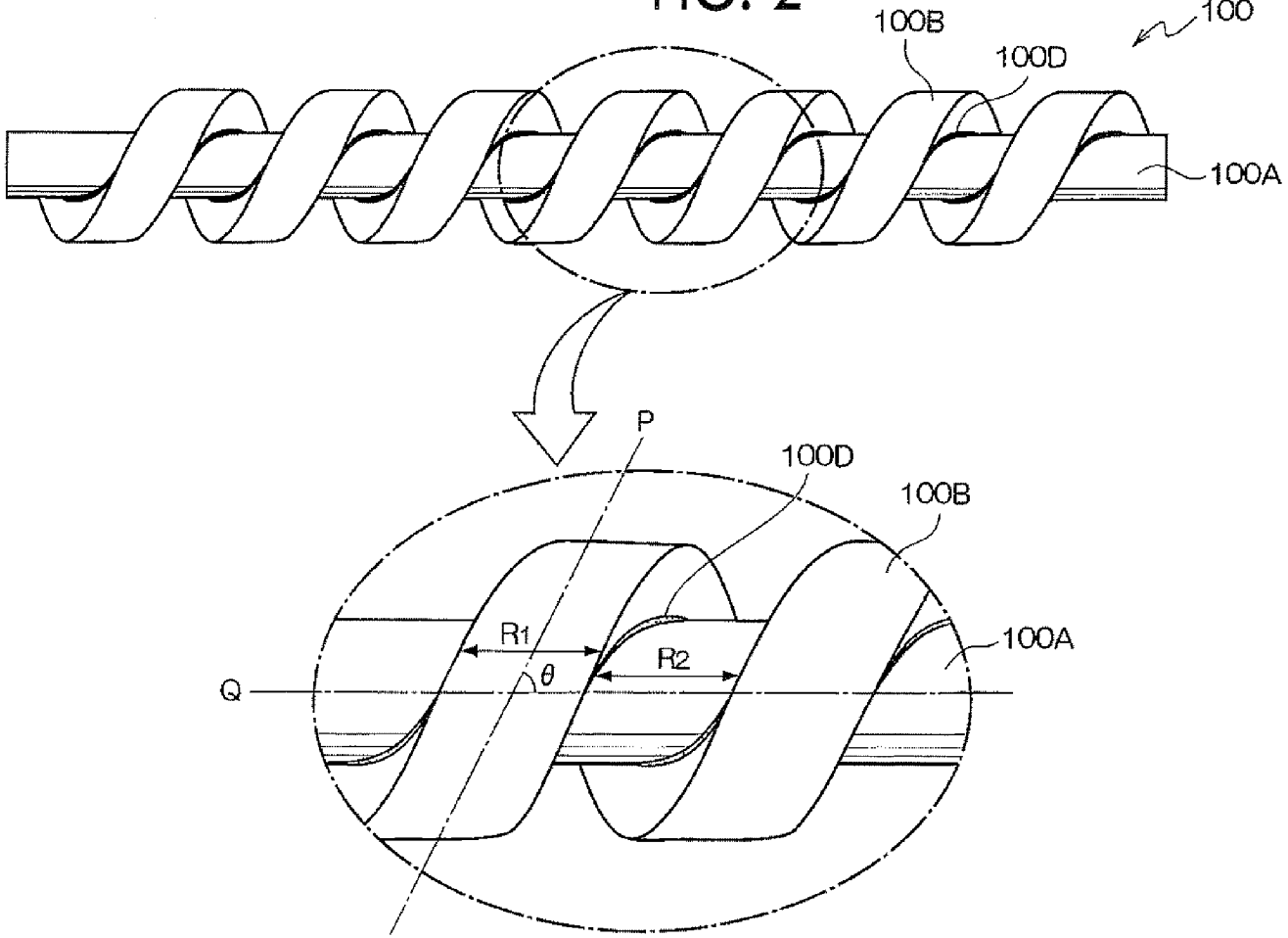
FIG. 2 is a schematic side view showing the cleaning member for an image forming apparatus according to the present exemplary embodiment.
Figure 3:
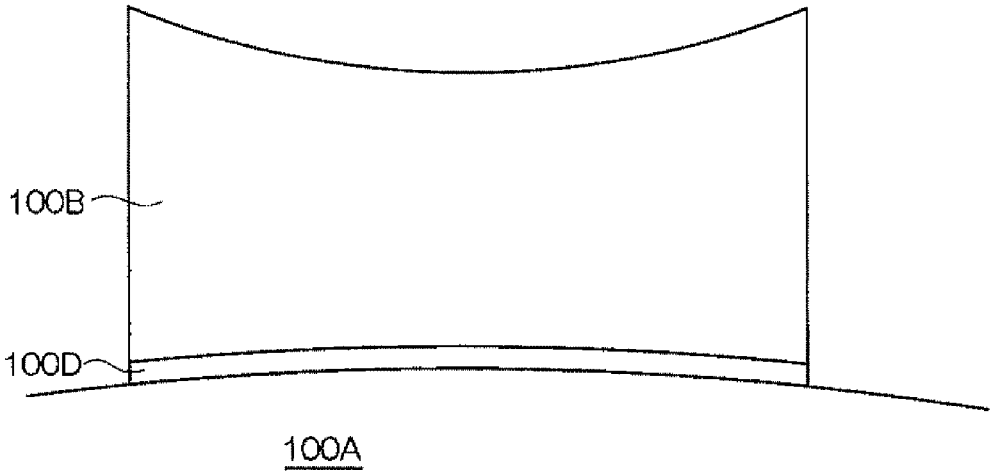
FIG. 3 is an enlarged cross-sectional view showing a foamed elastic layer of the cleaning member for an image forming apparatus according to the present exemplary embodiment.

FIG. 1 is a schematic perspective view showing a cleaning member for an image forming apparatus according to the present exemplary embodiment. FIG. 2 is a schematic plan view of the cleaning member for an image forming apparatus according to the present exemplary embodiment. FIG. 3 is an enlarged cross-sectional view showing a foamed elastic layer of the cleaning member for an image forming apparatus according to the present exemplary embodiment.

In addition, FIG. 3 is a cross-sectional view taken along the line A-A in FIG. 1, that is, a cross-sectional view in a direction orthogonal to the helical direction of the foamed elastic layer.

As shown in FIGS. 1 to 3, a cleaning member 100 for an image forming apparatus (hereinafter, simply referred to as a "cleaning member") according to this exemplary embodiment is a roll-shaped member that includes a core 100A, a foamed elastic layer 100B, and a bonding layer 100D for bonding the core 100A and the foamed elastic layer 100B together.

The foamed elastic layer 100B is formed by winding a strip-shaped foamed elastic member 100C (hereinafter referred to as a strip 100C) on an outer peripheral surface of the core 100A in a helical form so as to extend from one end to the other end of the core 100A. Specifically, for example, the foamed elastic layer 100B is disposed in a state where the strip 100C is wound in a helical form at intervals with the core 100A as the axis of a helix so as to extend from one end to the other end of the core 100A.

Within a surface at one or both ends at least in the longitudinal direction of the foamed elastic layer 100B on a side facing the outer peripheral surface of the core 100A (hereinafter, a surface of the foamed elastic layer 100B on the side facing the outer peripheral surface of the core 100A will be referred to as a "lower surface"), the area of a region contacting the outer peripheral surface of the core 100A via the bonding layer 100D is 35% or more by area ratio per unit area.

Here, in a case where the strip 100C is wound around the core 100A so that the foamed elastic layer 100B is disposed in a helical form on the outer peripheral surface of the core 100A, it is necessary to apply predetermined tension in the longitudinal direction (winding direction) of the strip 100C when winding the strip 100C around the outer peripheral surface of the core 100A. The foamed elastic layer 100B in a state of being wound around the core 100A is considered to be disposed in an elastically deformed state (for example, a state where the thickness of the central portion in the width direction of the strip 100C before winding is decreased).

On the other hand, since the foamed elastic layer 100B in a state of being wound around the core 100A is fixed along the outer peripheral surface of the core 100A in the elastically deformed state, it is considered that a repulsive elastic force corresponding to the elastic deformation amount of the foamed elastic layer 100B is generated. The repulsive elastic force is applied in a direction where the foamed elastic layer 100B is contracted, that is, the longitudinal direction (the winding direction of the strip 100C) of the foamed elastic layer 100B. Thus, it is considered that the repulsive elastic force is applied in a direction where one or both of the ends in the longitudinal direction of the foamed elastic layer 100B peels from the outer peripheral surface of the core 100A. In addition, it is considered that the foamed elastic layer 100B is easy to peel off since a stronger repulsive elastic force is applied as the thickness and elastic coefficients of the foamed elastic layer 100B and the radius of curvature of the core 100A increase.

Furthermore, since the foamed elastic layer 100B includes bubbles, a number of concave portions resulting from bubbles (foamed skeletal structures) are present on the lower surface of the foamed elastic layer 100B contacting the outer peripheral surface of the core 100A via the bonding layer 100D. Due to the presence of the concave portions, when the lower surface of the foamed elastic layer 100B and the outer peripheral surface of the core 100A are bonded by the bonding layer 100D, the percentage of a region within the lower surface of the foamed elastic layer 100B contacting the outer peripheral surface of the core 100A via the bonding layer 100D tends to decrease. Therefore, the bonding force is likely to become deficient.

Therefore, in a cleaning member 101 according to the present exemplary embodiment, within the lower surface of the foamed elastic layer 100B at one or both ends at least in the longitudinal direction, the area of a region contacting the outer peripheral surface of the core 100A via the bonding layer 100D is increased to 35% or more by area ratio per unit area.

In this way, it is considered that the total area of a region (portion) within the lower surface of the foamed elastic layer 100B being in direct contact with the core 100A via the bonding layer 100D at one or both ends at least in the longitudinal direction of the foamed elastic layer 100B is increased, and a greater bonding force is obtained. Thus, the foamed elastic layer 100B is suppressed from peeling from the core 100A (from the ends in the longitudinal direction of the foamed elastic layer 100B).

Moreover, when the cleaning member 101 is stored for a predetermined period (for example, 24 hours or longer) under a high-temperature environment (for example, under a temperature condition of 50° C.), the viscosity of the bonding layer 100D bonding the foamed elastic layer 100B and the core 100A weakens. Thus, the foamed elastic layer 100B is likely to peel from the core 100A (from the end in the longitudinal direction of the foamed elastic layer 100B). However, in the cleaning member 101 according to the present exemplary embodiment, even when the cleaning member 101 is stored for a predetermined period under such a high temperature environment, the foamed elastic layer 100B is suppressed from peeling from the core 100A (from the end in the longitudinal direction of the foamed elastic layer 100B, in particular).

In a charging device, a process cartridge, and an image forming apparatus including the cleaning member 100 according to the present exemplary embodiment, since the foamed elastic layer 100B is suppressed from peeling from the core 100A (from the end in the longitudinal direction of the foamed elastic layer 100B), deterioration of charging performance due to deficient cleaning of the charging member and image defects (for example, density unevenness) resulting therefrom are suppressed.

Hereinafter, the individual members will be described.

First, the core will be described.

Examples of the material of the core 100A include metals (for example, free-cutting steel and stainless steel) and resins (for example, polyacetal (POM) resin). The material and the surface treatment method may be selected according to need.

When the core 100A is formed of a metal, the core 100A may be plated. When the core 100A is formed of a material having no electrical conductivity, such as a resin, the material may be processed by a typical treatment such as plating to impart electrical conductivity or may be directly used as is.

Subsequently, the bonding layer will be described.

Although the bonding layer is not particularly limited as long as it can bond the core 100A and the foamed elastic layer 100B together, the bonding layer is formed of a double-sided adhesive tape and other adhesives, for example.

Subsequently, the foamed elastic layer will be described.

The foamed elastic layer 100B is formed of a material (so-called foam) having bubbles.

Examples of the material of the foamed elastic layer 100B include foaming resins such as polyurethane, polyethylene, polyamide, and polypropylene and rubber materials such as silicone rubber, fluorine rubber, urethane rubber, ethylene propylene diene rubber (EPDM), nitrile butadiene rubber (NBR), chloroprene rubber (CR), chlorinated polyisoprene, isoprene, acrylonitrile-butadiene rubber, styrene-butadiene rubber, hydrogenated polybutadiene, and butyl rubber, and any blends of two or more of these materials.

Assisting agents such as a foaming aid, a foam stabilizer, a catalyst, a curing agent, a plasticizer, or a vulcanization accelerator may be added to these materials.

The material of the foamed elastic layer 100B may be polyurethane foam highly resistant to stretching in order not to scratch the surface of the member to be cleaned and in order to prevent tearing and breaking over a long term.

Examples of the polyurethane include reaction products between a polyol (for example, polyester polyol, polyether polyester, or acryl polyol) and an isocyanate (such as 2,4-tolylene diisocyanate, 2,6-tolylene diisocyanate, 4,4-diphenylmethane diisocyanate, tolidine diisocyanate, or 1,6-hexamethylene diisocyanate). The polyurethane may contain a chain extender such as 1,4-butanediol or trimethylolpropane.

Foaming of polyurethane is typically conducted by using a foaming agent such as water or an azo compound (for example, azodicarbonamide, azobisisobutyronitrile, and the like).

An assisting agent such as a foaming aid, a foam stabilizer, or a catalyst may be added to the polyurethane foam if needed.

An ether-based polyurethane foam is particularly preferred. This is because ester-based polyurethane foam has a tendency to deteriorate under humidity and heat. A silicone oil foam stabilizer is typically used for the ether-based polyurethane. However, image defects caused by migration of silicone oil to the member to be cleaned (for example, charging roller) may occur during storage (in particular, long-term storage at high temperature and high humidity). Accordingly, a foam stabilizer other than silicone oil is used to prevent image defects caused by the foamed elastic layer 100B.

Examples of the foam stabilizer other than silicone oil include Si-free organic surfactants (for example, anionic surfactants such as dodecylbenzenesulfonic acid or sodium lauryl sulfate). A method disclosed in JP-A-2005-301000 that does not use a silicone foam stabilizer may also be employed.

Whether a foam stabilizer other than silicone oil is used in the ether-based polyurethane foam is determined by examining whether Si is contained through component analysis.

The thickness (thickness in the central portion in the width direction) of the foamed elastic layer 100B may be 1.0 mm to 3.0 mm, and preferably 1.4 mm to 2.6 mm, and more preferably 1.6 mm to 2.4 mm.

The thickness of the foamed elastic layer 100B is measured as follows, for example.

The cleaning member is scanned with a laser analyzer (Laser Scan Micrometer, model LSM 6200 produced by Mitsutoyo Corporation) in a longitudinal direction (axis direction) of the cleaning member at a traverse speed of 1 mm/s while having the circumferential direction of the cleaning member fixed so as to determine the profile of the foamed elastic layer thickness. After that, the same measurement is conducted by shifting the position of the scanning in the circumferential direction (measurement is conducted at three positions 120° apart from each other). The thickness of the foamed elastic layer 100B is calculated on the basis of this profile.

The foamed elastic layer 100B is disposed in a helical form. Specifically, the helical angle θ may be 10° to 65°, for example (preferably 20° to 50°). The helical width R1 may be 3 mm to 25 mm, for example, (preferably 3 mm to 10 mm). The helical pitch R2 may be 3 mm to 25 mm, for example (preferably 15 mm to 22 mm).

The coverage by the foamed elastic layer 100B determined by (R1/(R1+R2), where R1 is the helical width of the foamed elastic layer 100B, and R2 is the helical pitch of the foamed elastic layer 100B) may be 20% to 70%, and preferably 25% to 55%.

When the coverage is greater than the above range, since the period in which the foamed elastic layer 100B comes into contact with the member to be cleaned increases, deposits on the surface of the cleaning member 100 tend to re-contaminate the member to be cleaned. In contrast, when the coverage is below the above range, the thickness of the foamed elastic layer 100B is not easily stabilized and the cleaning performance may be deteriorated.

The helical angle θ is the angle (acute angle) between the longitudinal direction P (helical direction) of the foamed elastic layer 100B and the axis direction Q (core axis direction) of the cleaning member 100 of the foamed elastic layer 100B.

The helical width R1 is the length of the foamed elastic layer 100B in the axis direction Q (core axis direction) of the cleaning member 100.

The helical pitch R2 is the length between adjacent parts of the foamed elastic layer 100B in the axis direction Q (core axis direction) of the cleaning member 100.

The foamed elastic layer 100B refers to a layer formed of a material that returns to its original shape after being deformed by application of an external force of 100 Pa.

Although the area of a region within the lower surface at one or both ends at least in the longitudinal direction of the foamed elastic layer 100B contacting the outer peripheral surface of the core 100A via the bonding layer 100D is 35% or more by area ratio per unit area (hereinafter referred to as contact area ratio), the area is preferably 60% or more.

As the area ratio increases, it is easy to obtain a bonding force equal to or greater than the repulsive elastic force generated at one or both ends in the longitudinal direction of the foamed elastic layer 100B, and the foamed elastic layer 100B is suppressed from peeling from the core 100A (from the end in the longitudinal direction of the foamed elastic layer 100B in particular).

Although the entire region of the lower surface of the foamed elastic layer 100B may satisfy the above range of contact area ratio, from the perspective of cleaning performance, only the region of the lower surface at one or both ends in the longitudinal direction thereof may satisfy the above range of contact area ratio.

In addition, one or both of the ends in the longitudinal direction of the foamed elastic layer 100B satisfying the range of contact area ratio is a portion located within 10 mm (preferably within 5 mm) toward the central portion from both ends in the longitudinal direction of the foamed elastic layer 100B.

Here, "contact area ratio" is the percentage of the area of a region within the lower surface of the foamed elastic layer 100B contacting (being in direct contact with the bonding layer 100D) the outer peripheral surface of the core 100A via the bonding layer 100D to the total area (the projection area when projected in the thickness direction) of the lower surface of the foamed elastic layer 100B. In other words, since the lower surface of the foamed elastic layer 100B has a concave-convex shape, and the apexes (apex surfaces) of the convex portions are the portions contacting (being in direct contact with the bonding layer 100D) the outer peripheral surface of the core 100A via the bonding layer 100D, the "contact area ratio" is the percentage of the area of the apexes (apex surfaces) of the convex portions contacting the outer peripheral surface of the core 100A via the bonding layer 100D to the total area of the lower surface of the foamed elastic layer 100B.

The "contact area ratio" is a value calculated as follows.

A part of the foamed elastic layer 100B serving as a measurement target is peeled from the cleaning member 101 by a cutter to thereby obtain an elastic layer sample.

The elastic layer sample is placed on a horizontal ink table on which a liquid ink film (thickness: 100 μm) is formed so that a measurement target surface (the lower surface layer of the foamed elastic layer 100B) is in contact with ink. Then, the elastic layer sample is pressed from above with a force of 40 g/cm$^2$ so that a part (skeletal structure portion of foam) of the measurement target surface of the elastic layer is colored with ink.

Moreover, the measurement target surface of the elastic layer sample is photographed using a microscope (model VHX-200 produced by Keyence Corporation) to obtain images. The region of 1 mm by 1 mm of the photographed images is binarized into a colored portion and a non-colored portion using an image analysis software (WinROOF produced by Mitani Corporation). The percentage of a contact portion occupying the measurement target surface is measured and used as the contact area ratio.

In addition, the image analysis software uses binarization conditions such that image analysis processing is performed on photographed images processed to black and white with 255 gradations based on a threshold value obtained by "determinant analysis". A portion having a value equal to or greater than the threshold value is defined as a colored portion, and a portion having a value smaller than the threshold value is defined as a non-colored portion.

In order to obtain the "contact area ratio" in the above range, a method of performing compression processing (for example, thermal compression) in the thickness direction of the foamed elastic layer 100B at one or both ends at least in the longitudinal direction of the strip 100C (strip-shaped foamed elastic member) serving as the foamed elastic layer 100B may be used, for example.

Specifically, the strip 100C (strip-shaped foamed elastic member having a foaming ratio of 50 pieces per 25 mm to 70 pieces per 25 mm, for example) before winding around the core 100A is prepared. Then, compression processing is performed by applying heat and pressure to one or both ends at least in the longitudinal direction of the strip 100C so that the compression ratio (percentage of thickness after compression to thickness before compression) in the thickness direction is 10% to 70%.

The compression processing may be performed on a foamed elastic member before cutting in a strip form.

In this way, the foamed skeletal structures constituting the lower surface of the strip 100C (the foamed elastic layer 100B) are likely to disappear (but do not disappear completely), and the contact area ratio is likely to increase.

Moreover, in order to obtain the "contact area ratio" in the above range, a surface contacting the outer peripheral surface of the core via the bonding layer at one or both ends at least in the longitudinal direction of the strip 100C (strip-shaped foamed elastic member) serving as the foamed elastic layer 100B may be formed of an unfoamed layer, for example.

Specifically, the strip 100C (the foamed elastic layer 100B) may be configured as a laminate of an unfoamed layer and a foamed layer at one or both ends at least in the longitudinal direction thereof, for example.

This configuration is realized by cutting the strip 100C (the foamed elastic layer 100B) from the prepared elastic foam (a lump of molded foam before cutting: for example, urethane foam) so that a skin layer (an unfoamed layer constituting a surface contacting a mold) of the surface constitutes the lower surface of the strip 100C (the foamed elastic layer 100B).

In this way, the lower surface of the strip 100C (the foamed elastic layer 100B) is formed of an unfoamed layer, and the contact area ratio is likely to increase.

Figure 4:
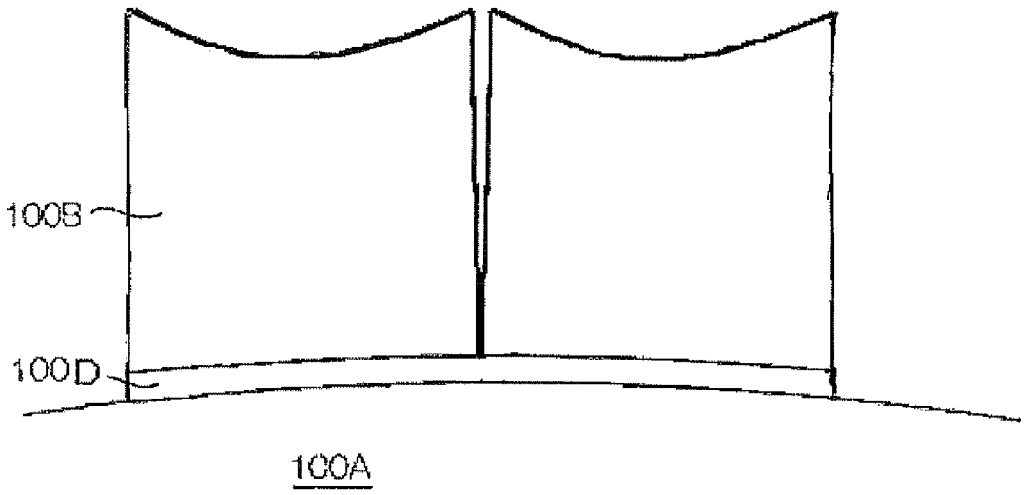
FIG. 4 is an enlarged cross-sectional view showing a foamed elastic layer of the cleaning member for an image forming apparatus according to another exemplary embodiment.

Here, the foamed elastic layer 100B is not limited to an aspect in which the foamed elastic layer 100B is composed of one strip 100C. As shown in FIG. 4, the foamed elastic layer 100B may be composed of at least two strips 100C (strip-shaped foamed elastic members), and at least two strips 100C may be wound around the core 100A.

By using a configuration in which the foamed elastic layer 100B is formed by winding at least two strips 100C in a helical form around the core 100A, it becomes easy to improve the cleaning performance of the cleaning member 100.

Although the cleaning performance may be improved more as the number of wound strips 100C increases, the helical width R1 of the wound foamed elastic layer 100B may be 3 mm to 25 mm, for example, and preferably 3 mm to 10 mm.

When the helical width R1 is 3 mm or less, it may sometimes be difficult to improve the cleaning performance sufficiently even if at least two strips 100C are used to form the foamed elastic layer 100B.

Moreover, the foamed elastic layer 100B formed by winding at least two strips 100C (strip-shaped foamed elastic members) in a helical form around the core 100A may be disposed by being wound in a helical form in a state where the sides in the longitudinal direction of a bonding surface (a surface of the strip 100C on a side facing the outer peripheral surface of the core 100A) of the strip 100C are in contact with each other. The foamed elastic member 100B may be disposed by being wound in a helical form in a state where the sides are not in contact with each other.

In particular, when the foamed elastic layer 100B is disposed by being wound in a helical form in a state where the sides in the longitudinal direction of the bonding surfaces of two strips 100C are in contact with each other, for example (see FIG. 4), since higher contact pressure is applied to the member to be cleaned as compared to a case (FIG. 3) of using one foamed elastic member with the same helical width R1, it is considered that it is easy to obtain more excellent cleaning performance.

FIG. 4 shows a configuration in which the foamed elastic layer 100B is composed of two strips 100C (strip-shaped foamed elastic members) and is disposed by being wound in a helical form in a state where the sides in the longitudinal direction of the bonding surfaces (surfaces of the strips 100C on a side facing the outer peripheral surface of the core 100A) of the two strips 100C are in contact with each other.

Next, a method of manufacturing the cleaning member 100 according to the exemplary embodiment will be described.

Figure 5A:
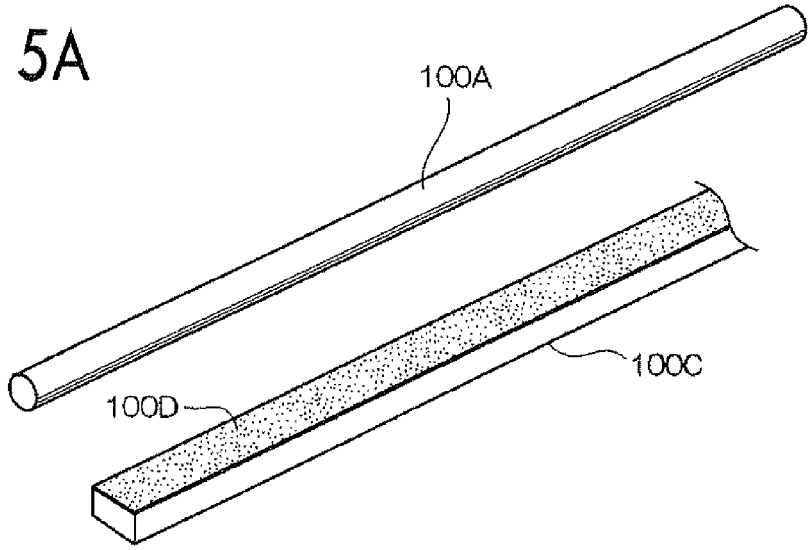
FIGS. 5A to 5C are diagrams showing an example of the steps of a method of manufacturing the cleaning member for an image forming apparatus according to the present exemplary embodiment.
Figure 5B:
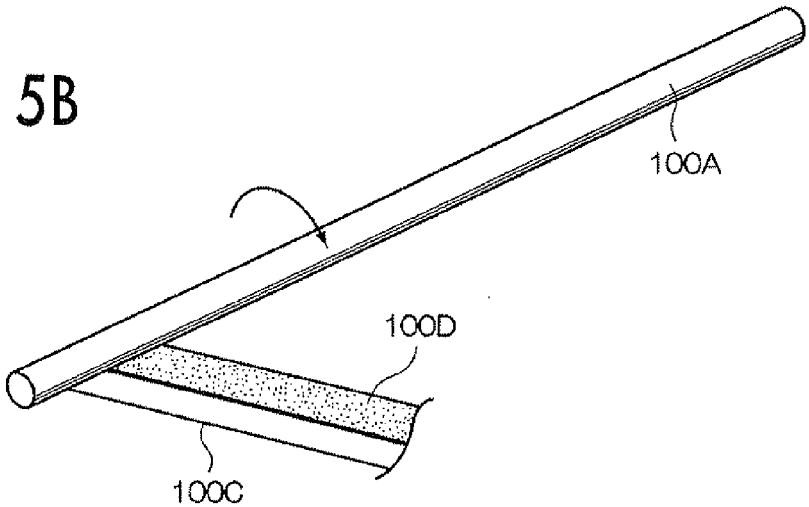
Figure 5C:
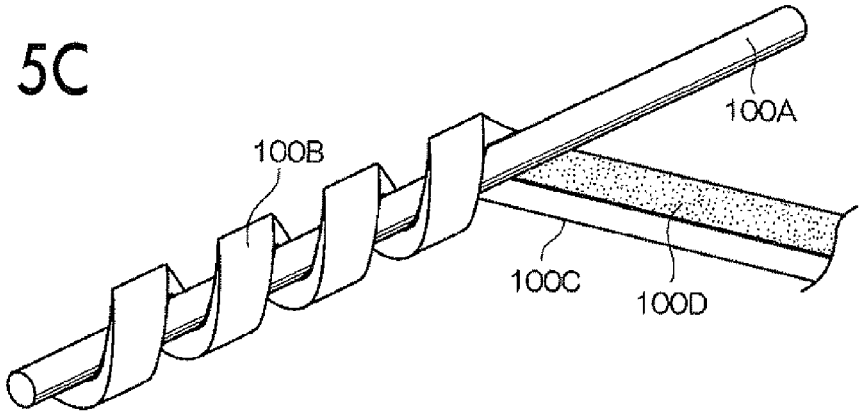

FIGS. 5A to 5C are diagrams showing an example of the steps of a method of manufacturing the cleaning member 100 according to the present exemplary embodiment.

First, as shown in FIG. 5A, a sheet-shaped foamed elastic member (polyurethane foam sheet or the like) sliced to a target thickness is prepared. A double-sided adhesive tape (not shown) is attached on one surface of the sheet-shaped foamed elastic member. The foamed elastic member is blanked out using a blanking die to obtain a strip 100C (strip-shaped foamed elastic member with a double-sided adhesive tape) having a target width and length. The core 100A is also prepared.

Here, in order to obtain the "contact area ratio" in the above range, compression processing may be performed on the sheet-shaped foamed elastic member, and compression processing may be performed on the obtained strip 100C. The compression processing may be performed before or after attaching the double-sided adhesive tape as the bonding layer 100D.

Moreover, in order to obtain the "contact area ratio" in the above range, when performing slicing to obtain the sheet-shaped foamed elastic member, the slicing may be performed so that the skin layer (an unfoamed layer constituting the surface contacting a mold) of the surface of the elastic foam before slicing constitutes the lower surface of the strip 100C (the foamed elastic layer 100B) to thereby obtain the sheet-shaped foamed elastic member.

Subsequently, as shown in FIG. 5B, the strip is placed so that the surface on which the double-sided adhesive tape is attached faces upward. In this state, one end of the releasing paper of the double-sided adhesive tape is detached, and one end of the core 100A is placed on the portion of the double-sided adhesive tape from which the releasing paper is detached.

Subsequently, as shown in FIG. 50, while detaching the releasing paper of the double-sided adhesive tape, the core 100A is rotated at a target speed so that the strip 100C is wound in a helical form around the outer peripheral surface of the core 100A to obtain a cleaning member 100 including the elastic layer 100B disposed in a helical form on the outer peripheral surface of the core 100A.

Here, when the strip 100C serving as the elastic layer 100B is wound around the core 100A, the position of the strip 100C may be adjusted so that the angle (helical angle) of the longitudinal direction of the strip 100C with respect to the axial direction of the core 100A becomes a target value. Moreover, the outer diameter of the core 100A may be about 3 mm to 6 mm, for example.

The tension applied when winding the strip 100C around the core 100A may be controlled so that no gap is formed between the core 100A and the double-sided adhesive tape of the strip 100C and so that excessively large tension is not applied. When excessively large tension is applied, tensional permanent elongation increases, and the elastic force of the foamed elastic layer 100B necessary for cleaning tends to decrease. Specifically, the tension may be controlled so that the length of the original strip 100C is elongated by greater than about 0% and about 5% or less.

On the other hand, when the strip 100C is wound around the core 100A, the strip 100C tends to be elongated. The elongation differs in the thickness direction of the strip 100C and tends to reach its maximum at the outermost portion, where the elastic force decreases. Thus, the elongation of the outermost portion after the strip 100C is wound around the core 100A may be about 5% that of the outermost portion of the original strip 100C.

The elongation is controlled by the radius of curvature of winding of the strip 100C around the core 100A and the thickness of the strip 100C. The radius of curvature of winding of the strip 100C around the core 100A is controlled by the outer diameter of the core 100A and the winding angle of the strip 100C.

The radius of curvature of winding of the strip 100C around the core 100A may be (core outer diameter)/2+0.2 mm to (core outer diameter)/2+8.5 mm, for example, and preferably (core outer diameter)/2+0.5 mm to (core outer diameter)/2+7.0 mm.

The thickness of the strip 100C may be 1.5 mm to 4 mm, for example, and preferably, 1.5 mm to 3.0 mm. Moreover, the width of the strip 100C may be adjusted so that the coverage of the foamed elastic layer 100B is in the above range. Moreover, the length of the strip 100C is determined by an axial length of a region wound around the core 100A, the winding angle, and the winding tension.

(Image Forming Apparatus and the Like)

Hereinafter, an image forming apparatus according to the present exemplary embodiment will be described with reference to the drawings.

Figure 6:
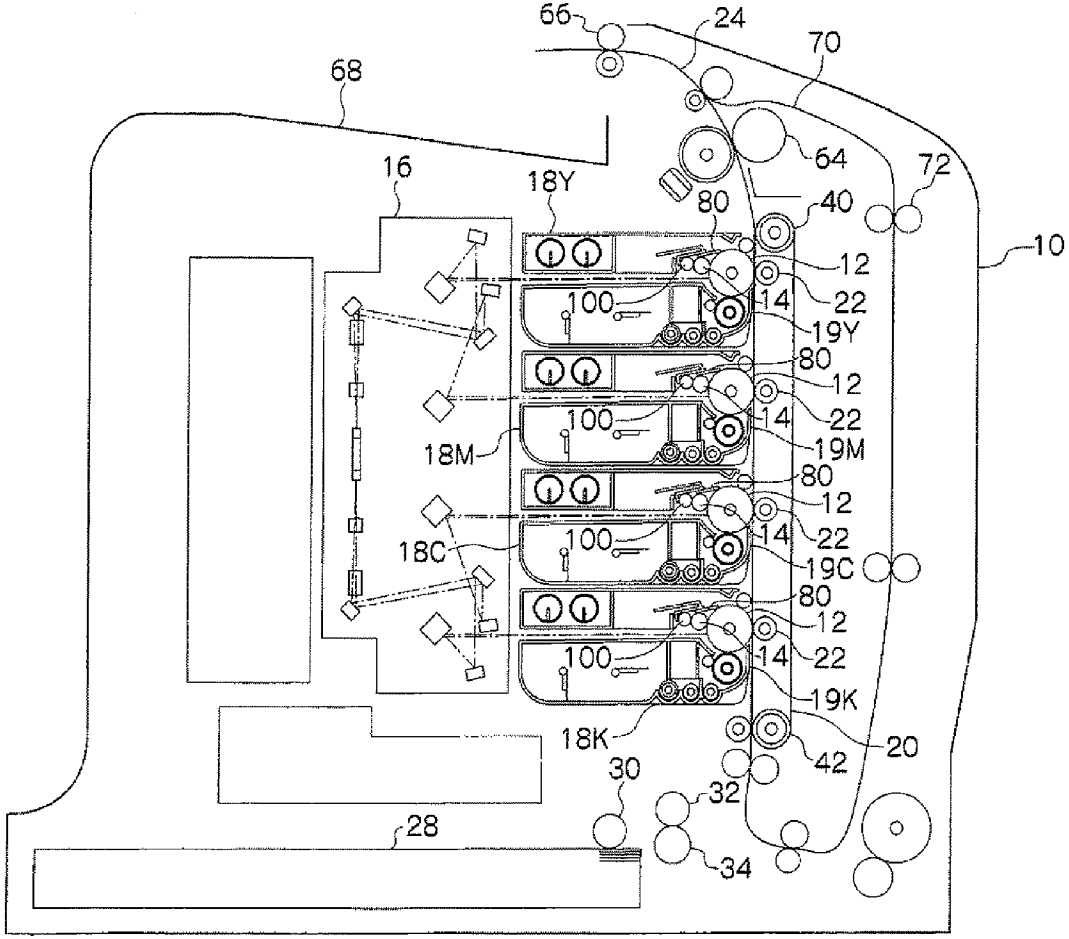
FIG. 6 is a schematic configuration diagram showing an electrophotographic image forming apparatus according to the present exemplary embodiment.

FIG. 6 is a schematic configuration diagram showing an image forming apparatus according to the present exemplary embodiment.

Figure 7:
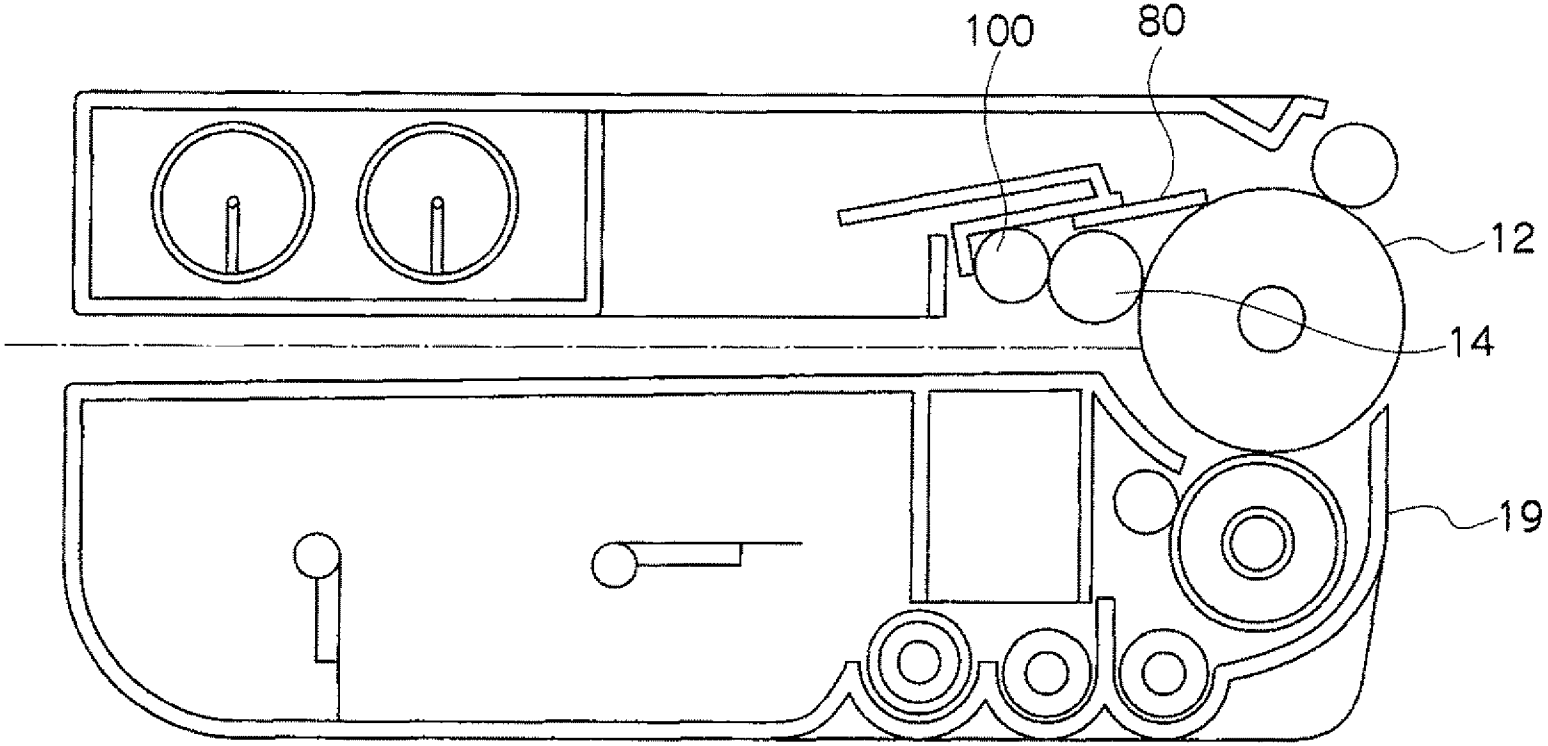
FIG. 7 is a schematic configuration diagram showing a process cartridge according to the present exemplary embodiment.

As shown in FIG. 6, an image forming apparatus 10 according to the present exemplary embodiment is a tandem color image forming apparatus, for example. Process cartridges (see FIG. 7) each including a photoconductor (image carrying member) 12, a charging member 14, a developing device, and other associated components are arranged inside the image forming apparatus 10. In this exemplary embodiment, four process cartridges 18Y, 18M, 18C, and 18K are respectively provided for four colors of yellow, magenta, cyan, and black. The process cartridges are detachably mounted on the image forming apparatus 10.

The photoconductor 12 is, for example, a conductive cylindrical body having a diameter of 25 mm and coated with a photoconductor layer formed of an organic photosensitive material formed on a surface, and is rotated at a process speed of 150 mm/sec by a motor not shown in the drawing.

The surface of the photoconductor 12 is charged with the charging member 14 put on the surface of the photoconductor 12 and irradiated with a laser beam LB emitted from an exposure device 16 so as to form an electrostatic latent image, which corresponds to image information, on the downstream side of the charging member 14 in the rotation direction of the photoconductor 12.

The electrostatic latent images formed on the photoconductors 12 are respectively developed with developing devices 19Y, 19M, 19C, and 19K for yellow (Y), magenta (M), cyan (C), and black (K) to form toner images of the four colors.

For example, when a color image is to be formed, the process of charging, exposing, and developing is conducted on the surface of each of the photoconductors 12 corresponding to yellow (Y), magenta (M), cyan (C), and black (K) so as to form a yellow toner image, a magenta toner image, a cyan toner image, and a black toner image on the photoconductors 12, respectively.

The yellow (Y), magenta (M), cyan (C), and black (K) toner images sequentially formed on the photoconductors 12 are transferred onto a recording sheet 24 at positions where the photoconductors 12 contact the transfer devices 22 via a sheet transport belt 20 while the recording sheet 24 is transported on an outer peripheral surface of the sheet transport belt 20 given tension by and supported by supporting rollers 40 and 42 from the inner peripheral side. The recording sheet 24 that has received the toner images from the photoconductors 12 is transported to a fixing device 64 and heated and pressured by the fixing device 64 to fix the toner images on the recording sheet 24. The recording sheet 24 with toner images fixed thereon is ejected with an ejection roll 66 onto an ejection unit 68 in the upper part of the image forming apparatus 10 when the printing is to be performed on only one side of the sheet.

The recording sheet 24 is supplied from a sheet container 28 by using a feed roller 30 and transported with transport rolls 32 and 34 to the sheet transport belt 20.

In the case where double-side printing is to be conducted, the recording sheet 24 with toner images fixed on a first surface (front surface) by the fixing device 64 is not ejected onto the ejecting unit 68 by the ejection roll 66. Instead, the ejection roll 66 holding the rear end of the recording sheet 24 is reversed while the transport path of the recording sheet 24 is switched to a sheet transport path 70 for double-side printing. The recording sheet 24 with its side reversed is again transported onto the sheet transport belt 20 by using a transport roll 72 installed on the sheet transport path 70 so as to transfer toner images onto a second surface (rear surface) of the recording sheet 24 from the photoconductors 12. The toner images on the second surface (rear surface) of the recording sheet 24 are fixed with the fixing device 64 and the recording sheet 24 (member to be transferred) is ejected onto the ejecting unit 68.

Whenever the photoconductor 12 rotates once, the surface of the photoconductor 12 after the toner image transfer step is cleaned with a cleaning blade 80 arranged downstream of the position that has come into contact with the transfer device 22 in the rotation direction of the photoconductor 12. This cleaning is conducted every time the photoconductor 12 is rotated to remove residual toner, paper dust, and the like, and to prepare for the next image formation.

Figure 8:
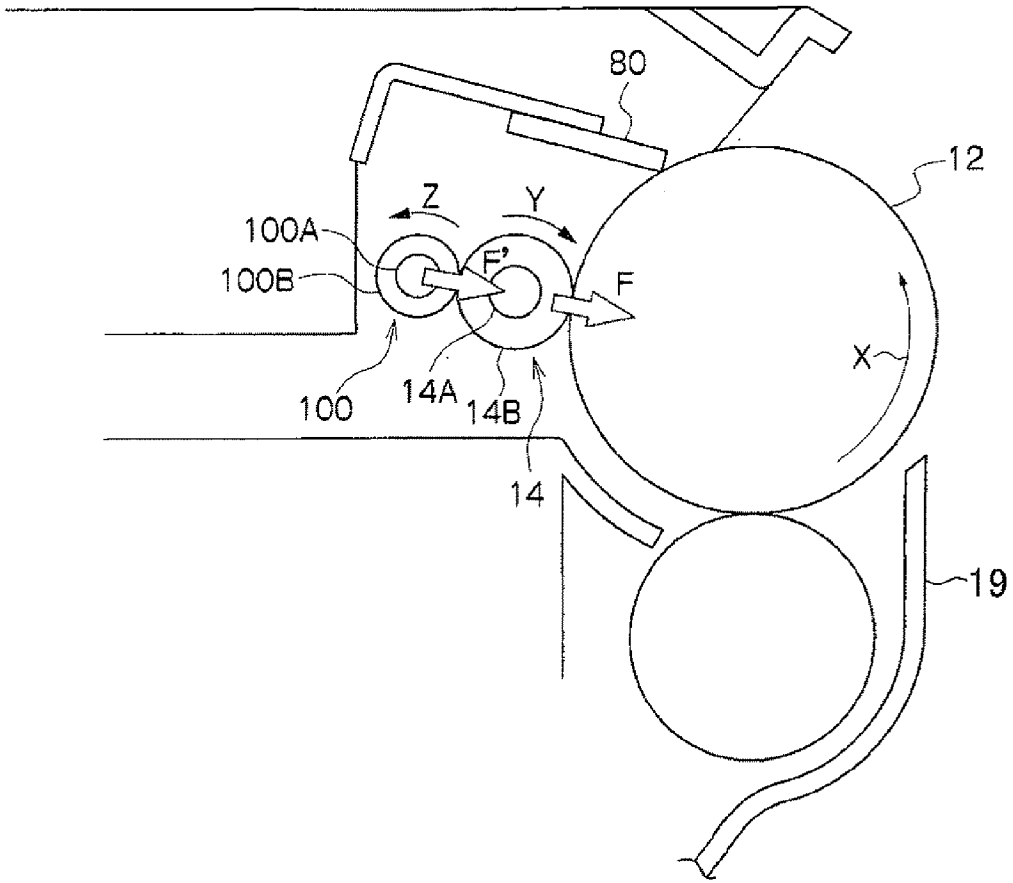
FIG. 8 is an enlarged schematic configuration diagram showing a vicinity of a charging member (charging device) shown in FIGS. 6 and 7.

As shown in FIG. 8, the charging member 14 is, for example, a roll including a rotatably supported conductive core 14A and a foamed elastic layer 14B surrounding the core 14A. A cleaning member 100 for cleaning the charging member 14 is in contact with a side of the charging member 14 remote from the photoconductor 12. The cleaning member 100 is part of a charging device (unit). The cleaning member 100 of the present exemplary embodiment is used as the cleaning member 100.

The description below concerns the case in which the cleaning member 100 is always in contact with the charging member 14 and driven by the charging member 14. However, the cleaning member 100 may be always in contact with and driven by the charging member 14, and may be brought into contact with and driven by the charging member 14 only during cleaning of the charging member 14. Alternatively, the cleaning member 100 may be brought into contact with the charging member 14 only during cleaning and driven separately so as to have a peripheral speed different from that of the charging member 14. However, having the cleaning member 100 always in contact with the charging member 14 and creating a difference in peripheral speed may be avoided since contamination on the charging member 14 accumulates on the cleaning member 100 and may re-deposit on the charging roll.

The charging member 14 is pressed against the photoconductor 12 by application of a load F to both ends of the core 14A so that a nip portion is formed along the peripheral surface of the foamed elastic layer 14B by elastic deformation. The cleaning member 100 is pressed against the charging member 14 by application of a load F' to both ends of the core 100A so that a nip portion is formed along the peripheral surface of the charging member 14 by elastic deformation of the foamed elastic layer 100B. As a result, a nip portion is formed in the axis direction of the charging member 14 and the photoconductor 12 while suppressing the deflection of the charging member 14.

The photoconductor 12 is rotated in the direction indicated by the arrow X by a motor not shown in the drawing and the charging member 14 is driven in the direction indicated by the arrow Y by the rotation of the photoconductor 12. The cleaning member 100 is driven by the rotation of the charging member 14 and rotates in the direction indicated by the arrow Z.

[Configuration of Charging Member]

The charging member is described below but the configuration of the charging member is not limited by the description.

The configuration of the charging member is not particularly limited. For example, the charging member may include a core and a foamed elastic layer or a resin layer instead of the foamed elastic layer. The foamed elastic layer may have a single-layer structure or a multilayer structure including two or more layers having various functions. The foamed elastic layer may be surface-treated.

The material of the core may be free-cutting steel or stainless steel. The material and the surface treatment method may be appropriately selected according to the property such as slidability. The core may be plated. When a material having no electrical conductivity is used, the material may be processed by a typical treatment such as plating to impart electrical conductivity or may be directly used as is.

The foamed elastic layer is a conductive foamed elastic layer. For example, the conductive foamed elastic layer may contain, an elastic material such as rubber, a conductive material such as carbon black and an ion conductive material which adjusts the resistance of the conductive foamed elastic layer, and any additives commonly used as needed, such as a softener, a plasticizer, a curing agent, a vulcanizing agent, a vulcanization accelerator, an antioxidant, and a filler such as silica or calcium carbonate. The foamed elastic layer is formed by coating the peripheral surface of the conductive core with a mixture of these materials. Examples of the conductive agent for adjusting the resistance include carbon black blended with a matrix material and a dispersion of a conductive material that uses at least one of electrons and ions as charge carriers, such as an ion conductive material. The elastic material may be foam.

The elastic material constituting the conductive foamed elastic layer is formed by dispersing a conductive agent in a rubber material. Examples of the rubber material include silicone rubber, ethylene propylene rubber, epichlorohydrin-ethylene oxide copolymer rubber, epichlorohydrin-ethylene oxide-allyl glycidyl ether copolymer rubber, acrylonitrile-butadiene copolymer rubber, and blended rubbers of these. These rubber materials may be foamed or unfoamed.

Examples of the conductive agent include electronic conductive agents and ion conductive agents. Examples of the electronic conductive agents include fine particles formed of carbon black such as Ketjenblack and acetylene black; pyrolytic carbon and graphite; various conductive metals such as aluminum, copper, nickel, and stainless steel and alloys thereof; conductive metal oxides such as tin oxide, indium oxide, titanium oxide, tin oxide-antimony oxide solid solution, and tin oxide-indium oxide solid solution; and insulating materials having surfaces treated to exhibit conductivity. Examples of the ion conductive agent include perchloric acid salts and chlorates such as tetraethylammonium and lauryltrimethylammonium; and perchloric acid salts and chlorates of alkali metals and alkaline earth metals such as lithium and magnesium.

These conductive agents may be used alone or in combination of two or more. The amounts of these conductive agents added are not particularly limited. The amount of the electronic conductive agent may be 1 to 60 parts by weight relative to 100 parts by weight of rubber material. The amount of the ion conductive agent may be 0.1 to 5.0 parts by weight relative to 100 parts by weight of rubber material.

A surface layer may be formed in the surface of the charging member. The material of the surface layer may be resin, rubber, or any other suitable material and is thus not particularly limited. Examples of the material of the surface layer include polyvinylidene fluoride, ethylene tetrafluoride copolymers, polyester, polyimide, and copolymer nylon.

Examples of the copolymer nylon include those that contain at least one of nylon 610, nylon 11, and nylon 12 as a polymerization unit. Examples of other polymerization unit contained in the copolymer include nylon 6 and nylon 66. The ratio of a polymerization unit constituted by nylon 610, nylon 11, and/or nylon 12 in the copolymer may be 10% by weight or more in total.

The polymer materials may be used alone or in combination of two or more. The number-average molecular weight of the polymer material is preferably 1,000 to 100,000 and more preferably 10,000 to 50,000.

A conductive material may be added to the surface layer to control the resistance. A conductive material may have a particle size of 3 μm or less.

Examples of the conductive agent for adjusting the resistance include carbon black and conductive metal oxide particles blended with a matrix material, and a dispersion of a conductive material that uses at least one of electrons and ions as charge carriers, such as an ion conductive material.

Examples of carbon black used as a conductive agent include Special Black 350, Special Black 100, Special Black 250, Special Black 5, Special Black 4, Special Black 4A, Special Black 550, Special Black 6, Color Black FW200, Color Black FW2, and Color Black FW2V produced by Degussa, and MONARCH 1000, MONARCH 1300, MONARCH 1400, MOGUL-L, and REGAL 400R produced by CABOT CORPORATION.

Carbon black has a pH of 4.0 or less.

The conductive metal oxide particles used as conductive particles for adjusting resistance is not particularly limited and may be any conductive particles that use electrons as charge carriers. Examples thereof include tin oxide, antimony-doped tin oxide, zinc oxide, anatase-type titanium oxide, and indium tin oxide (ITO). These may be used alone or in combination of two or more. The particle size is not particularly limited. The conductive particles are preferably tin oxide, antimony-doped tin oxide, or anatase-type titanium oxide and more preferably tin oxide or antimony-doped tin oxide.

The surface layer may be formed of a fluorine-based or silicone-based resin. In particular, the surface layer may be formed of a fluorine-modified acrylate polymer. Particles may be added to the surface layer. Insulating particles such as alumina or silica may be added to impart irregularities on the surface of the charging member so that the frictional load imposed during contact with the photoconductor is decreased and the wear resistance between the charging member and the photoconductor is improved.

The outer diameter of the charging member may be 8 mm to 16 mm. The outer diameter is measured with a commercially available caliper or a laser-system outer diameter measuring device.

The microhardness of the charging member may be 45° to 60°. In order to decrease hardness, the amount of plasticizer added may be increased or a low-hardness material such as silicone rubber may be used.

The microhardness of the charging member may be measured with MD-1 durometer produced by Kobunshi Keiki Co., Ltd.

The image forming apparatus of the exemplary embodiment includes a photoconductor (image carrying member), a charging device (unit constituted by a charging member and a cleaning member), a developing device, and a cleaning blade (cleaning device) but the image forming apparatus is not limited to this. For example, a charging device (unit constituted by a charging member and a cleaning member) and, if needed, at least one selected from a photoconductor (image carrying member), an exposing device, a transfer device, a developing device, and a cleaning blade (cleaning device) may be combined to form a process cartridge. It should be noted that these devices and members need not be formed into a cartridge and may be directly installed in the image forming apparatus.

The image forming apparatus of the exemplary embodiment described above includes a charging device which is a unit constituted by a charging member and a cleaning member, in other words, a structure in which the charging member is the member to be cleaned. However, the structure is not limited to this. The member to be cleaning may be a photoconductor (image carrying member), a transfer device (transfer member or transfer roll), and/or an intermediate transfer member (intermediate transfer belt). The unit constituted by the member to be cleaned and the cleaning member in contact with the member to be cleaned may be installed directly on the image forming apparatus or may be formed into a cartridge as with the process cartridge described above and installed in the image forming apparatus.

The image forming apparatus of the exemplary embodiment is not limited to one having the above-described structure. Image forming apparatuses of an intermediate transfer type and other known types may be employed.

EXAMPLES

The present invention will now be described with reference to Examples below which do not limit the present invention.

Example 1

Preparation of Cleaning Roll 1

A double-sided adhesive tape having a thickness of 0.15 mm is attached to a sheet of urethane foam (EP-70, product of INOAC CORPORATION) having a thickness of 3 mm, and the sheet is cut into a strip having a thickness (the thickness in the central portion in the width direction) of 3 mm, a width of 10 mm, and a length of 356 mm.

The obtained strip is placed on a horizontal table so that the releasing paper attached to the double-sided adhesive tape faces downward. The strip is compressed from above using heated stainless steel so that the overall thickness of the strip (strip formed of polyurethane foam excluding the double-sided adhesive tape) is decreased to 62%.

Subsequently, the compressed strip is wound around a metal core (outer diameter: 6 mm, entire length: 331 mm) with a winding angle of 40° while applying tension so that the entire length of the strip is extended by greater than about 0% and about 5% or less. In this way, a foamed elastic layer disposed in a helical form is formed.

In this way, a cleaning roll 1 as the cleaning member is obtained.

(Preparation of Charging Roll)

Formation of Foamed Elastic Layer

A mixture described below is kneaded with an open roll, applied on a surface of a conductive support formed of SUS 416 stainless steel 6 mm in diameter so as to form a cylindrical body having a thickness of 3 mm, placed in a cylindrical die having an inner diameter of 18.0 mm, vulcanized for 30 minutes at 170° C., released from the die, and polished to obtain a cylindrical conductive foamed elastic layer A.

Rubber material: 100 parts by mass (epichlorohydrin-ethylene oxide-allyl glycidyl ether copolymer rubber) Gechron 3106: product of ZEON CORPORATION Conductive agent (carbon black Asahi Thermal, product of ASAHI CARBON CO., LTD) 25 parts by mass Conductive agent (Ketjenblack EC: product of Lion Corporation) 8 parts by mass Ion conductive agent (lithium perchlorate) 1 part by mass Vulcanizing agent (sulfur) 200 mesh: product of Tsurumi Chemical Co. 1 part by mass Vulcanization accelerator (Nocceler DM: product of OUCHI SHINKO CHEMICAL INDUSTRIAL CO., LTD) 2.0 parts by mass Vulcanization accelerator (Nocceler TT: product of OUCHI SHINKO CHEMICAL INDUSTRIAL CO., LTD) 0.5 parts by mass Formation of Surface Layer A dispersion A obtained by dispersing the mixture below with a bead mill is diluted with methanol, applied on a surface of the conductive foamed elastic layer A by dip-coating, and thermally dried at 140° C. for 15 minutes to form a surface layer having a thickness of 4 μm to obtain a conductive roll. This conductive roll is used as a charging roll.

Polymer material 100 parts by weight (copolymer nylon) Amilan CM8000: product of Toray Industries, Inc.

Conductive agent 30 parts by mass (Antimony-doped tin oxide) SN-100P: product of ISHIHARA SANGYO KAISHA LTD.

Solvent (methanol) 500 parts by mass

Solvent (butanol) 240 parts by mass

Example 2

Preparation of Cleaning Roll 2

A cleaning roll 2 is obtained in a manner similarly to the cleaning roll 1 except that the strip (strip formed of polyurethane foam excluding the double-sided adhesive tape) is compressed so that the overall thickness of the strip is decreased to 43%.

(Preparation of Charging Roll)

The same charging roll as prepared in Example 1 is used.

Example 3

Preparation of Cleaning Roll 3

A cleaning roll 3 is obtained in a manner similarly to the cleaning roll 1 except that the strip (strip formed of polyurethane foam excluding the double-sided adhesive tape) is compressed so that the overall thickness of the strip is decreased to 25%.

(Preparation of Charging Roll)

The same charging roll as prepared in Example 1 is used.

Example 4

Preparation of Cleaning Roll 4

A cleaning roll 4 is obtained in a manner similarly to the cleaning roll 1 except that the strip (strip formed of polyurethane foam excluding the double-sided adhesive tape) is compressed so that the overall thickness of the strip is decreased to 18%.

(Preparation of Charging Roll)

The same charging roll as prepared in Example 1 is used.

Example 5

Preparation of Cleaning Roll 5

A sheet sliced so that one surface (one of the surfaces facing in the thickness direction) becomes a skin layer (an unfoamed layer constituting the surface contacting a mold) of urethane foam is prepared as the sheet of urethane foam (EP-70, product of INOAC CORPORATION) having a thickness of 3 mm.

A double-sided adhesive tape having a thickness of 0.15 mm is attached to a surface formed of the skin layer of the urethane foam sheet having a surface formed of the skin layer, and the sheet is cut into a strip having a thickness (the thickness in the central portion in the width direction) of 3 mm, a width of 10 mm, and a length of 356 mm.

The cleaning roll 5 is obtained in a manner similarly to the cleaning roll 1 except that the obtained strip is used.

(Preparation of Charging Roll)

The same charging roll as prepared in Example 1 is used.

Example 6

Preparation of Cleaning Roll 6

A cleaning roll 6 is obtained in a manner similarly to the cleaning roll 1 except that the strip (strip formed of polyurethane foam excluding the double-sided adhesive tape) is compressed so that the thickness of only both ends (portions within 10 mm toward the central portion from both ends) in the longitudinal direction of the strip is decreased to 62%.

(Preparation of Charging Roll)

The same charging roll as prepared in Example 1 is used.

Example 7

Preparation of Cleaning Roll 7

A cleaning roll 7 is obtained in a manner similarly to the cleaning roll 1 except that the strip (strip formed of polyurethane foam excluding the double-sided adhesive tape) is compressed so that the thickness of only both ends (portions within 10 mm toward the central portion from both ends) in the longitudinal direction of the strip is decreased to 43%.

(Preparation of Charging Roll)

The same charging roll as prepared in Example 1 is used.

Example 8

Preparation of Cleaning Roll 8

A cleaning roll 8 is obtained in a manner similarly to the cleaning roll 1 except that the strip (strip formed of polyurethane foam excluding the double-sided adhesive tape) is compressed so that the thickness of only both ends (portions within 10 mm toward the central portion from both ends) in the longitudinal direction of the strip is decreased to 25%.

(Preparation of Charging Roll)

The same charging roll as prepared in Example 1 is used.

Example 9

Preparation of Cleaning Roll 9

A cleaning roll 9 is obtained in a manner similarly to the cleaning roll 1 except that the strip (strip formed of polyurethane foam excluding the double-sided adhesive tape) is compressed so that the thickness of only both ends (portions within 10 mm toward the central portion from both ends) in the longitudinal direction of the strip is decreased to 18%.

(Preparation of Charging Roll)

The same charging roll as prepared in Example 1 is used.

Example 10

Preparation of Cleaning Roll 10

A cleaning roll 10 is obtained in a manner similarly to the cleaning roll 1 except that two strips are cut in a manner similarly to the preparation of the cleaning roll 1 except that the width is 5 mm, the strips are compressed so that the overall thickness of the compressed strips are decreased to 62%, and the compressed strips are wound in a helical form in a state where the sides in the longitudinal direction of the bonding surface are in contact with each other.

(Preparation of Charging Roll)

The same charging roll as prepared in Example 1 is used.

Example 11

Preparation of Cleaning Roll 11

A cleaning roll 11 is obtained in a manner similarly to the cleaning roll 1 except that two strips having a width of 5 mm having a surface formed of a skin layer are prepared in a manner similarly to the preparation of the cleaning roll 5, and the strips are wound in a helical form in a state where the sides in the longitudinal direction of the bonding surface are in contact with each other.

(Preparation of Charging Roll)

The same charging roll as prepared in Example 1 is used.

Example 12

Preparation of Cleaning Roll 12

A cleaning roll 12 is obtained in a manner similarly to the cleaning roll 1 except that two strips are cut in a manner similarly to the preparation of the cleaning roll 1 except that the width is 5 mm, the strips are compressed so that the thickness of only both ends (portions within 10 mm toward the central portion from both ends) in the longitudinal direction of the strips is decreased to 62%, and the compressed strips are wound in a helical form in a state where the sides in the longitudinal direction of the bonding surface are in contact with each other.

(Preparation of Charging Roll)

The same charging roll as prepared in Example 1 is used.

Example 13

Preparation of Cleaning Roll 13

A cleaning roll 13 is obtained in a manner similarly to the cleaning roll 1 except that two strips are cut in a manner similarly to the preparation of the cleaning roll 1 except that the width is 5 mm, the strips are compressed so that the overall thickness of the strips is decreased to 62%, and the compressed strips are wound in a helical form so that the sides in the longitudinal direction of the bonding surface are spaced by 2 mm on the outer periphery of the core.

(Preparation of Charging Roll)

The same charging roll as prepared in Example 1 is used.

Example 14

Preparation of Cleaning Roll 14

A cleaning roll 14 is obtained in a manner similarly to the cleaning roll 1 except that two strips having a width of 5 mm and having a surface formed of a skin layer are prepared in a manner similarly to the preparation of the cleaning roll 5, and the compressed strips are wound in a helical form so that the sides in the longitudinal direction of the bonding surface are spaced by 2 mm on the outer periphery of the core.

(Preparation of Charging Roll)

The same charging roll as prepared in Example 1 is used.

Example 15

Preparation of Cleaning Roll 15

A cleaning roll 15 is obtained in a manner similarly to the cleaning roll 1 except that two strips are cut in a manner similarly to the preparation of the cleaning roll 1 except that the width is 5 mm, the strips are compressed so that the thickness of only both ends (portions within 10 mm toward the central portion from both ends) in the longitudinal direction of the strips is decreased to 62%, and the compressed strips are wound in a helical form so that the sides in the longitudinal direction of the bonding surface are spaced by 2 mm on the outer periphery of the core.

(Preparation of Charging Roll)

The same charging roll as prepared in Example 1 is used.

Example 16

Preparation of Cleaning Roll 16

A cleaning roll 16 is obtained in a manner similarly to the cleaning roll 1 except that three strips are cut in a manner similarly to the preparation of the cleaning roll 1 except that the width is 3.3 mm, the strips are compressed so that the overall thickness of the strips is decreased to 62%, and the compressed strips are wound in a helical form so that the sides in the longitudinal direction of the bonding surface are in contact with each other with the three strips in a line.

(Preparation of Charging Roll)

The same charging roll as prepared in Example 1 is used.

Comparative Example 1

Preparation of Comparative Cleaning Roll 1

A comparative cleaning roll 1 is obtained in a manner similarly to the cleaning roll 1 except that the strip (strip formed of polyurethane foam excluding the double-sided adhesive tape) is compressed so that the overall thickness of the strip is decreased to 77%.

(Preparation of Charging Roll)

The same charging roll as prepared in Example 1 is used.

Comparative Example 2

Preparation of Comparative Cleaning Roll 2

A comparative cleaning roll 2 is obtained in a manner similarly to the cleaning roll 1 except that the strip (strip formed of polyurethane foam excluding the double-sided adhesive tape) is compressed so that the thickness of only both ends (portions within 10 mm toward the central portion from both ends) in the longitudinal direction of the strip is decreased to 77%.

(Preparation of Charging Roll)

The same charging roll as prepared in Example 1 is used.

Comparative Example 3

Preparation of Comparative Cleaning Roll 3

A comparative cleaning roll 1 is obtained in a manner similarly to the cleaning roll 1 except that the strip (strip formed of polyurethane foam excluding the double-sided adhesive tape) is not compressed.

(Preparation of Charging Roll)

The same charging roll as prepared in Example 1 is used.

[Evaluation]

The "contact area ratio" of the lower surface (the lower surface at both ends in the longitudinal direction of the foamed elastic layer) of the foamed elastic layer of the cleaning roll prepared in each example is measured by the above-described method.

The peeling and cleaning properties of the foamed elastic layer of the cleaning roll are evaluated using the cleaning roll and the charging roll prepared in each example.

The evaluation results are shown in Table 1.

(Evaluation of Peeling Property)

The cleaning roll and the charging roll prepared in each example are installed in a drum cartridge of a color copier DocuCentre-IV C2260 produced by Fuji Xerox Co., Ltd. The drum cartridge is left in an environment of a temperature 50° C. and a humidity of 75 RH % for 30 days. The peeling property of the foamed elastic layer of the cleaning roll is evaluated based on the following criteria.

The state of the occurrence of peeling of the foamed elastic layer of the cleaning roll determined in this evaluation is observed in a state where one or both ends in the longitudinal direction of the foamed elastic layer is separated by 1 mm from the metal core.

Evaluation of Peeling Property: Determination Criteria

G0: Peeling does not occur

G1: The length of peeled urethane foam is 10 mm or less

G2: The length of peeled urethane foam is 10 mm or more (Evaluation of Cleaning Property)

The cleaning roll and the charging roll after the evaluation of the peeling property are installed in a drum cartridge of a color copier DocuCentre-IV C2260 produced by Fuji Xerox Co., Ltd, and an evaluation test of cleaning property is performed.

In the evaluation test, an image pattern having an average image density of 5% is printed on 10,000 and 100,000 pieces of A4-sized paper under an environment of a temperature of 30° C. and a humidity of 75 RH %. After that, a halftone image having a density of 30% is printed. Density unevenness caused by cleaning unevenness of the charging roll is measured using an X-rite 404 at 10 random locations. The cleaning property is evaluated based on the following criteria from the difference between the maximum value and the minimum value.

Evaluation of Cleaning Property: Determination Criteria

G0: The difference between the maximum value and the minimum value is 0.05 or less G1: The difference between the maximum value and the minimum value is greater than 0.05 and equal to and smaller than 0.10

G2: The difference between the maximum value and the minimum value is greater than 0.10 and equal to or smaller than 0.15

G3: The difference between the maximum value and the minimum value is greater than 0.15

The results show that Examples are superior to Comparative Examples in both peeling and cleaning properties.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning member for an image forming apparatus, comprising:

a core including an outer peripheral surface;

an elastic layer comprising:

(i) a strip-shaped foamed elastic member wound on the outer peripheral surface of the core in a helical form at spaced intervals so as to extend from one end of the core to the other end;

(ii) two ends in a longitudinal direction; and (iii) an inner surface comprising a concave-convex shape that faces the outer peripheral surface of the core; and a bonding layer that bonds the core and the elastic layer together, wherein, at a region of the inner surface at one or both of the two ends of the elastic layer, a percentage of an area of apexes of convex portions of the inner surface bonded to the outer peripheral surface of the core via the bonding layer is substantially 35% or more by area ratio per unit area.

TABLE 1

| | Cleaning roll | Processing | | Contact area ratio (%) | Evaluation of Peeling Property | Evaluation of Cleaning Property: after printing 10,000 sheets | Evaluation of Cleaning Property: after printing 100,000 sheets |
|---|---|---|---|---|---|---|---|
| Example 1 | Cleaning roll 1 | Entire elastic layer is compressed | Strip width 10 mm × 1 Piece | 40 | G0 | G2 | G3 |
| Example 2 | Cleaning roll 2 | Entire elastic layer is compressed | Strip width 10 mm × 1 Piece | 57 | G0 | G2 | G3 |
| Example 3 | Cleaning roll 3 | Entire elastic layer is compressed | Strip width 10 mm × 1 Piece | 62 | G0 | G2 | G3 |
| Example 4 | Cleaning roll 4 | Entire elastic layer is compressed | Strip width 10 mm × 1 piece | 70 | G0 | G2 | G3 |
| Example 5 | Cleaning roll 5 | Lower layer of elastic layer is formed of skin layer | Strip width 10 mm × 1 Piece | 88 | G0 | G2 | G3 |
| Example 6 | Cleaning roll 6 | Ends of elastic layer are compressed | Strip width 10 mm × 1 Piece | 40 | G0 | G0 | G1 |
| Example 7 | Cleaning roll 7 | Ends of elastic layer are compressed | Strip width 10 mm × 1 Piece | 57 | G0 | G0 | G1 |
| Example 8 | Cleaning roll 8 | Ends of elastic layer are compressed | Strip width 10 mm × 1 Piece | 62 | G0 | G0 | G1 |
| Example 9 | Cleaning roll 9 | Ends of elastic layer are compressed | Strip width 10 mm × 1 Piece | 70 | G0 | G0 | G1 |
| Example 10 | Cleaning roll 10 | Entire elastic layer is compressed | Strip width 5 mm × 2 Pieces | 40 | G0 | G1 | G2 |
| Example 11 | Cleaning roll 11 | Lower layer of elastic layer is formed of skin layer | Strip width 5 mm × 2 Pieces | 88 | G0 | G1 | G2 |
| Example 12 | Cleaning roll 12 | Ends of elastic layer are compressed | Strip width 5 mm × 2 Pieces | 40 | G0 | G0 | G0 |
| Example 13 | Cleaning roll 13 | Entire elastic layer is compressed | Strip width 5 mm × 2 Pieces | 40 | G0 | G1 | G2 |
| Example 14 | Cleaning roll 14 | Lower layer of elastic layer is formed of skin layer | Strip width 5 mm × 2 Pieces | 88 | G0 | G1 | G2 |
| Example 15 | Cleaning roll 15 | Ends of elastic layer are compressed | Strip width 5 mm × 2 Pieces | 40 | G0 | G0 | G0 |
| Example 16 | Cleaning roll 16 | Entire elastic layer is compressed | Strip width 3.3 mm × 3 Pieces | 40 | G0 | G1 | G1 |
| Comparative Example 1 | Comparative cleaning roll 1 | Entire elastic layer is compressed | Strip width 10 mm × 1 Piece | 33 | G1 | G1 | G2 |
| Comparative Example 2 | Comparative cleaning roll 2 | Ends of elastic layer are compressed | Strip width 10 mm × 1 Piece | 33 | G1 | G0 | G2 |
| Comparative Example 3 | Comparative cleaning roll 3 | None | Width 10 mm × 1 Piece | 23 | G2 | G0 | G2 |

2. The cleaning member for an image forming apparatus of claim 1, wherein at least one end of the elastic layer is compressed in a thickness direction of the elastic layer.

3. The cleaning member for an image forming apparatus of claim 2, wherein the inner surface of at least one end of the elastic layer, bonded to the outer peripheral surface of the core via the bonding layer is formed of an unfoamed layer.

4. The cleaning member for an image forming apparatus of claim 1, wherein a surface of at least one end of the elastic layer bonded to the outer peripheral surface of the core via the bonding layer is formed of an unfoamed layer.

5. The cleaning member for an image forming apparatus of claim 1, wherein the elastic layer is formed of at least two strip-shaped foamed elastic members and is disposed by being wound in a helical form around the core such that at least one side of each of the at least two strip-shaped foamed elastic members are in contact with each other.

6. The cleaning member for an image forming apparatus of claim 1, wherein the elastic layer is formed of at least two strip-shaped foamed elastic members and is disposed by being wound in a helical form around the core such that the sides in the longitudinal direction of the at least two strip-shaped foamed elastic members are not in contact with each other.

7. A charging device comprising:

a charging member that charges a member to be charged; and the cleaning member for an image forming apparatus of claim 1, the cleaning member being disposed in contact with a surface of the charging member so as to clean the surface of the charging member.

8. A process cartridge comprising the charging device of claim 7, wherein the process cartridge is detachably mounted on the image forming apparatus.

9. An image forming apparatus comprising:

an image carrying member;

a charging unit including the charging device of claim 7, the charging unit charging a surface of the image carrying member;

a latent image forming unit that forms a latent image on the charged surface of the image carrying member;

a developing unit that develops the latent image formed on the image carrying member with toner to form a toner image; and a transfer unit that transfers the toner image to a member to be transferred.

10. A unit for an image forming apparatus, comprising:

a member to be cleaned; and the cleaning member for an image forming apparatus of claim 1, the cleaning member being disposed in contact with a surface of the member to be cleaned so as to clean the surface of the member to be cleaned.

11. A process cartridge comprising:

the unit for an image forming apparatus of claim 10, wherein the unit is detachably mounted on the image forming apparatus.

12. An image forming apparatus comprising:

the unit for an image forming apparatus of claim 10.

13. The cleaning member for an image forming apparatus of claim 1, wherein the elastic layer covers 20% to 70% of the outer peripheral surface between the one end and the other end of the core.

14. A cleaning member for an image forming apparatus, comprising:

a core including an outer peripheral surface;

an elastic layer comprising (i) a strip-shaped foamed elastic member wound on the outer peripheral surface of the core in a helical form at intervals so as to extend from one end of the core to the other end; (ii) two ends in a longitudinal direction; and (iii) an inner surface that faces the outer peripheral surface of the core; and a bonding layer that bonds the core and the elastic layer together, wherein, at a region of the inner surface at one or both of the two ends of the elastic layer, an area bonded to the outer peripheral surface of the core via the bonding layer is substantially 35% or more by area ratio per unit area, and wherein the elastic layer is formed of at least two strip-shaped foamed elastic members and is disposed by being wound in a helical form around the core such that the sides in the longitudinal direction of the at least two strip-shaped foamed elastic members are not in contact with each other.

* * * * *